United States Patent [19]

Over et al.

[11] 3,938,246

[45] Feb. 17, 1976

[54] METHOD AND APPARATUS FOR ATTACHING MULTI-CONDUCTOR FLAT CABLE TO AN ELECTRICAL CONNECTOR

[75] Inventors: William Roderick Over, Harrisburg; Paul William Gress, Newmanstown, both of Pa.

[73] Assignee: AMP Incorporated, Harrisburg, Pa.

[22] Filed: Feb. 6, 1975

[21] Appl. No.: 547,524

[52] U.S. Cl. ..... 29/628; 29/33 M; 29/203 DT; 29/203 MW

[51] Int. Cl.[2] ..... H01R 43/04

[58] Field of Search ..... 29/628, 203 DT, 203 DS, 29/203 D, 203 C, 203 MW, 33 K, 33 M

[56] References Cited

UNITED STATES PATENTS 3,774,284 11/1973 Coutes ..... 29/203 C 3,886,641 6/1975 Davis ..... 29/203 MW

*Primary Examiner*—Carl E. Hall

*Attorney, Agent, or Firm*—Frederick W. Waring; Robert W. Pitts; Jay L. Seitchik

[57] ABSTRACT

An apparatus for use in attaching multi-conductor flat cable to an electrical connector having conductor receiving portions facing in opposite directions is disclosed. The apparatus employs a movable ram which moves through multiple strokes to perform all of the necessary steps. A movable connector holder is utilized so that cables may be attached to opposite faces of the connector by using only a single movable ram.

8 Claims, 10 Drawing Figures

90
92
86
96
88
94
96
94

2
78
80
84
76

4
6
38
46
44
7
40
42
16
14
28
30
26
32
24
20
18
22
36
36
12
10
34
14'
12
13
8

METHOD AND APPARATUS FOR ATTACHING MULTI-CONDUCTOR FLAT CABLE TO AN ELECTRICAL CONNECTOR

BACKGROUND OF THE INVENTION

1. Field of Invention

This invention relates to the attachment of electrical conductors to multi-contact electrical connectors. An apparatus is presented which enables all of the steps necessary for such attachment to be accomplished by the movement of punching and inserting means into and out of a central work zone.

2. Description of Prior Art

U.S. Pat. applications Ser. Nos. 368,387 and 413,092 disclose a method of making an electrical connection between a multi-contact connector and a multi-conductor flat cable. These applications both show a connector scheme composed of three elements; a multi-contact electrical connector, a multi-conductor flat cable, and a series of stuffer pins. The apparatus disclosed and claimed herein is a tool which is capable of forming a complete assembly composed of these three elements. The subject apparatus employs opposed punching and insertion means together with an intermediate connector holding means. Only one set of punching and insertion means are movable. A movable connector holding means is employed so that the other set of cooperating punching means and inserting means may remain stationary. U.S. application Ser. No. 479,380 now U.S. Pat. No. 3,886,641 discloses a tool having one movable insertion means and a movable intermediate connector holding means. That application, however, does not disclose a tool having a multiplicity of cooperating elements present with the instant invention. The presence of the three component elements necessitates a structure allowing access from several directions to a central working zone where all of the operations are accomplished. The instant invention permits such access.

BRIEF SUMMARY OF THE INVENTION

This invention employs a movable ram means, a fixed base means and an intermediate movable connector holding means all dispersed around a central working zone. The base has a movable die and a fixed insertion punch. A flat cable, a stuffer strip and a multi-contact electrical connector may be brought together in this working zone, where all of the required operations may be performed by actuation of a single movable ram means. Flat cable may be prepared for attachment and attached to the connector by multiple strokes of a single movable ram.

It is an object of this invention to supply a single tool to perform all the necessary steps to attach an electrical connector to the end of a flat cable. It is a further object of this invention to provide a tool which can attach flat cables on opposite surfaces of a connector in one operation. Another object of this invention is to attach three separate elements; a stuffer pin strip, a flat cable and an electrical connector in one operation without the need of previously joining the stuffer pin strip to the flat cable. One other object of this invention is to furnish a tool which can prepare the flat cable for attachment to the connector as well as perform the actual attachment, all through essentially the same action.

BRIEF DESCRIPTION OF THE DRAWINGS

FIG. 2 has been sub-divided into FIGS. 2A, 2B, and 2C, each sub-division showing a separate element.

FIG. 7 is a plan view showing the connector holder, the fixed insertion means, and the movable die.

DETAILED DESCRIPTION OF THE INVENTION

Figures 2, 2A, 2B, 2C:
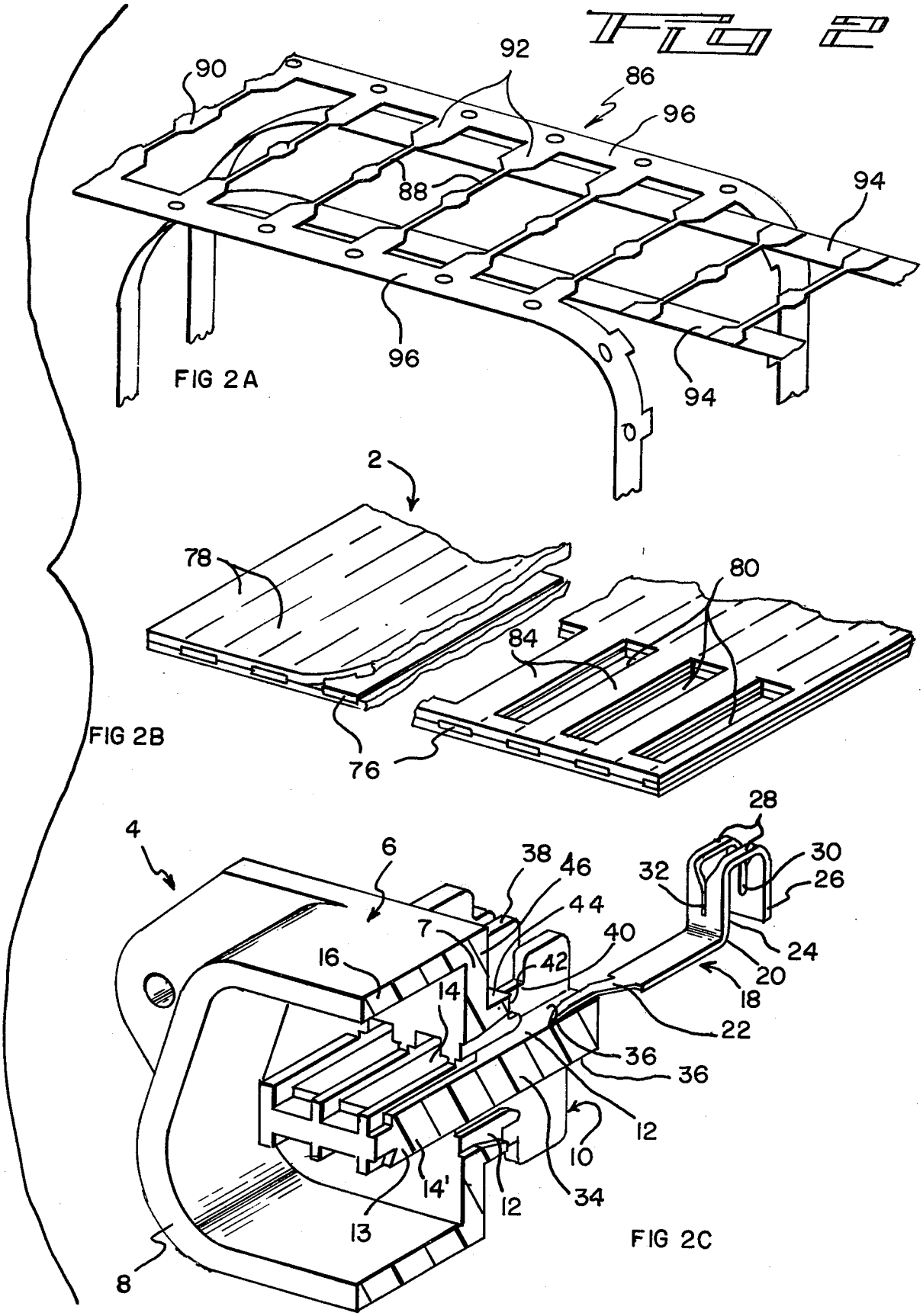
FIG. 2 shows the three elements of the final cable-connector assembly.

FIG. 2 shows the three elements which are joined together when a multi-contact electrical connector such as that shown is attached to the end of a flat cable. FIG. 2 has been sub-divided into FIGS. 2A, 2B, and 2C to simplify discussion of the separate elements.

The instant invention is directed to an apparatus for the achievement of improved electrical connections between the flat ribbon-like conductors 76 of a flat cable 2 to the terminals of a connector described below. As shown in FIG. 2B, the flat conductors are contained in a web 78 of suitable insulating material such as Mylar polyethyleneterephthalate in parallel spaced apart relationship.

Figure 4:
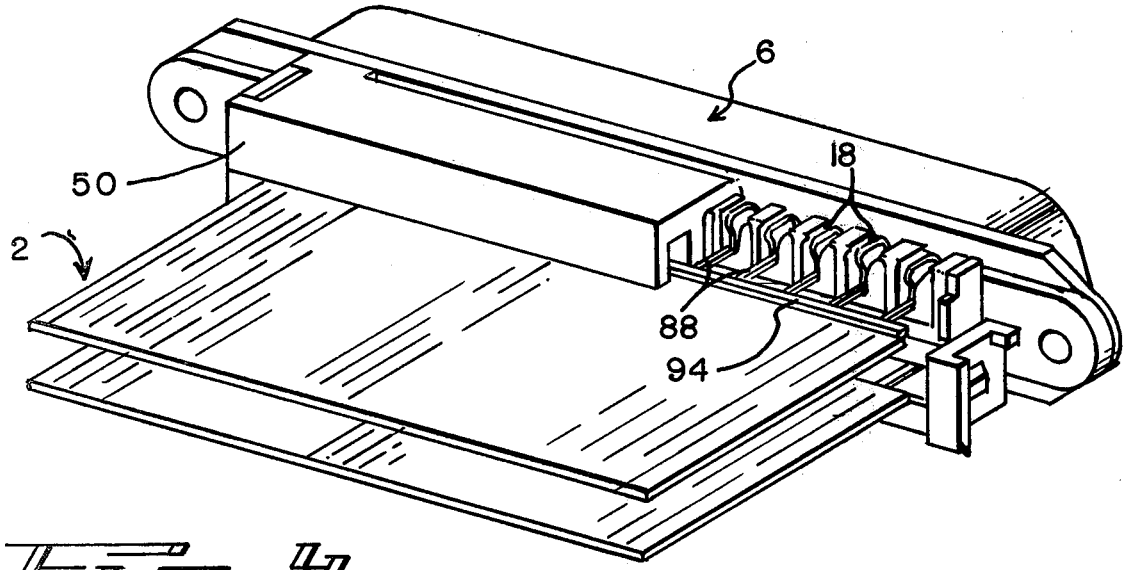
FIG. 4 shows a connector with two flat cables attached to oppositely facing rows of contact terminals.
Figure 4:
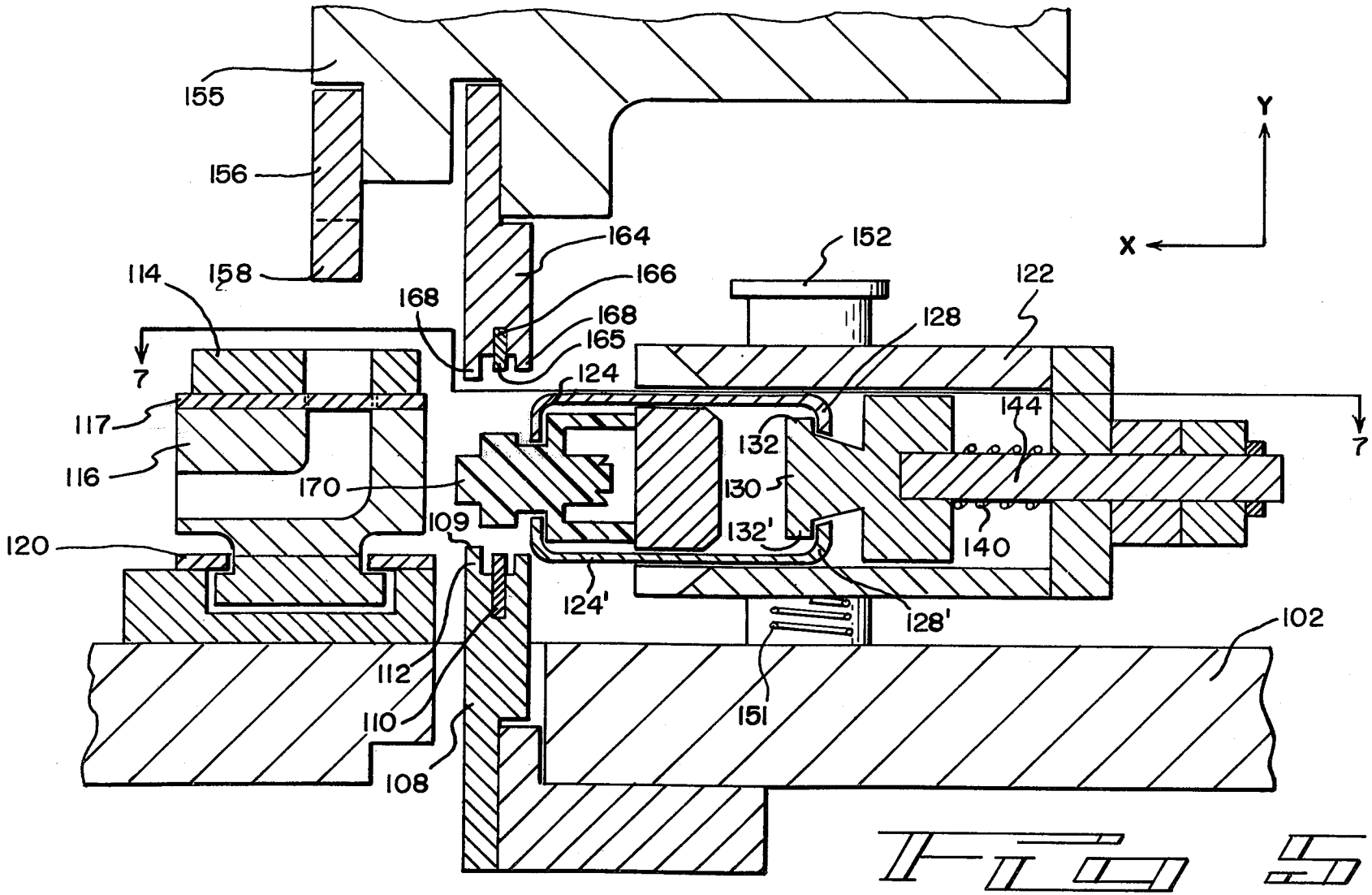

The connector 4 (FIGS. 2 and 4) comprises a housing 6 having a central body portion 7, a mating side 8, and a rearward side 10. Contact receiving cavities 12 extend leftwardly from the rearward side to the mating side and open onto the surfaces 14, 14' of a rib 13 which projects centrally from the body portion. As will be apparent from FIG. 2, the connector is substantially symmetrical about its horizontal center line and the same reference numerals, differentiated by prime marks, are used for the corresponding structural elements on the upper and lower sides of this center line. In the interest of brevity, only the upper portion of the connector is described in detail.

A hood 16 projects forwardly from body portion 7 in surrounding relationship to the rib 13, this hood being adapted to surround a complementary connector part when mated therewith.

The individual contact terminals 18 which are contained in the cavities 12 have a central shank portion 20, a contact arm of reduced width 22 which extends from the shank, and a pair of spaced apart plate sections 24, 26 on the rearward end of the shank. The plate sections are joined to each other at their upper ends by parallel straps 28 between which a conductor is moved into slots 30, 32 in the plate sections when the conductor is to be electrically connected to the terminal. These plate sections and the associated slots constitute the conductor receiving portion of this particular terminal.

A rib 34 projects from the rearward side of the housing and has a surface 36 on which the shank portions 20 of the terminals are supported. Vertically extending barrier plates 38 extend upwardly from the surface 36 and function to isolate the individual terminals each from the other. At their righthand ends, as viewed in FIG. 2, the dimensions of these barrier plates are such that their edges are beyond the plate sections 24, 26 and straps 28. The barriers are of reduced height adjacent to the body portion of the housing as shown at 40 and merge with a rearwardly facing surface 42 which extends normally of the surface 36. Surface 42 merges with a ledge 44 which is parallel to surface 36 and this ledge in turn merges with another rearwardly facing surface 46 of the intermediate body portion 7 of the housing.

Figure 3:
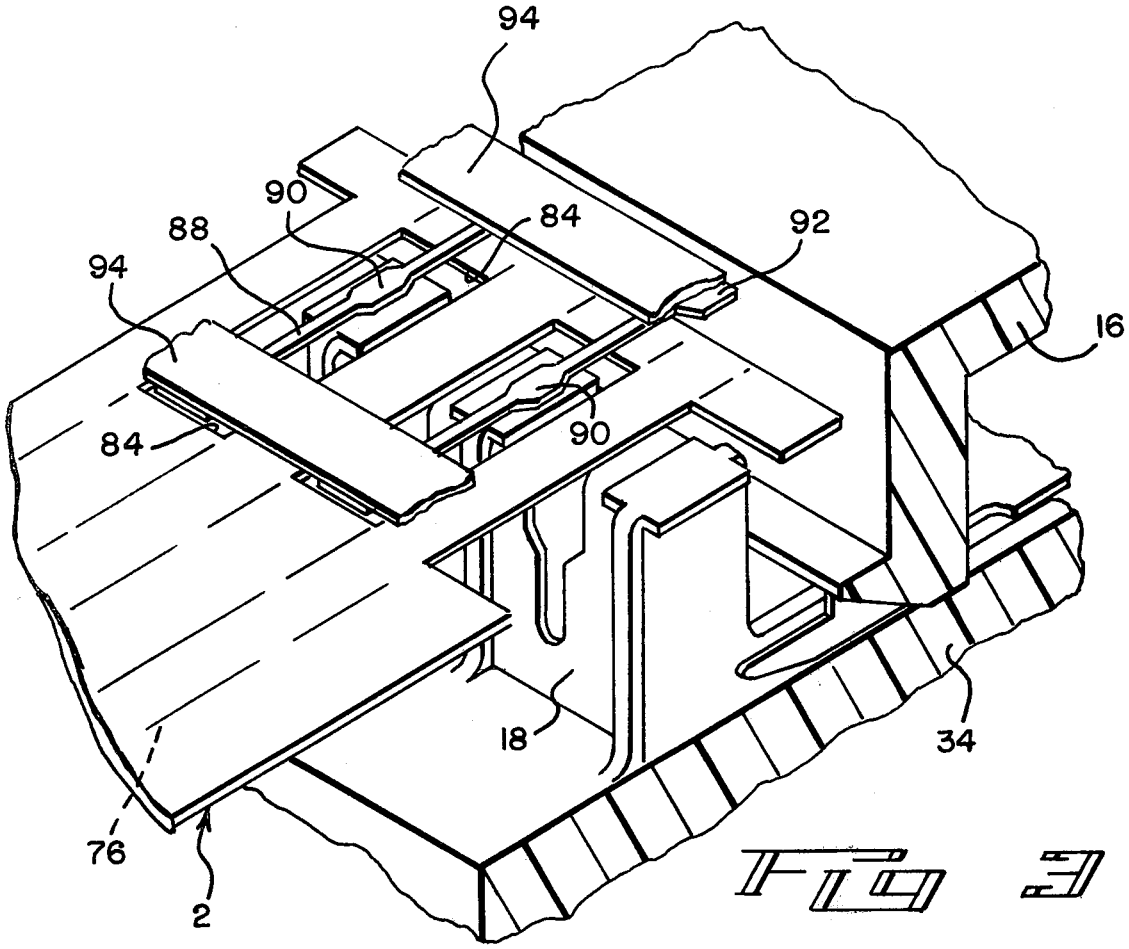
FIG. 3 shows a close-up of the aligned stuffer pins, the flat cable, and the conductor-receiving slots employed with the connector discussed herein.

When the conductors 76 are to be connected to the conductor receiving portions of the terminals 18, holes 80 are punched in the cable between adjacent conductors and the end portion of the cable is located adjacent to the rearwardly facing surface 46 of the housing with the individual conductors in alignment with the slots of the terminals as shown in FIG. 3. A section of stuffer pin strip 86 is located relatively above the cable with stuffer pins 88 in alignment with the individual conductors. This stuffer pin strip (FIG. 2A) carries a plurality of spaced apart flat stuffer pins 88 having centrally enlarged portions 90. The pins have enlarged ends 92 which are bonded to spaced-apart parallel carrier strips 94 of suitable plastic as described below.

When the electrical connections between the conductors and the terminals are formed, the stuffer pin strip and the conductors of the cable are simply moved downwardly as viewed in FIG. 3 and into the inner portions of the slots 30, 32. The edges of the slots penetrate the insulation on the under sides of the conductors and establish electrical contact therewith and the conductors become wrapped around the pins so that the pins maintain the conductors in contact with the edges of the slots.

Referring now to FIG. 2A, the stuffer pin strip can be manufactured by simply punching openings in a thin strip of sheet metal to form two metallic carrier strips 96 with the stuffer pins 88 integral with, and extending between, these carrier strips ladder-rung fashion. Pilot holes as shown are ordinarily punched in the carrier strips at the time of manufacture. The plastic carrier strips 94 are then bonded to the enlarged portions 92 of the stuffer pins 88 and the metallic carrier strips can then be removed by shearing the enlarged portions of the pins from these metallic carrier strips. The plastic carrier strips 94 are advantageously of Mylar (polyethyleneterephthalate) and are provided with a thin film (about 1 mil) of adhesive comprising a co-polymer of ethylene and acrylic acid. The enlarged portions of the stuffer pins can then be heat bonded to the carrier strips and the stuffer pins will thus be accurately positioned on the plastic carrier strips 94.

Figure 1:
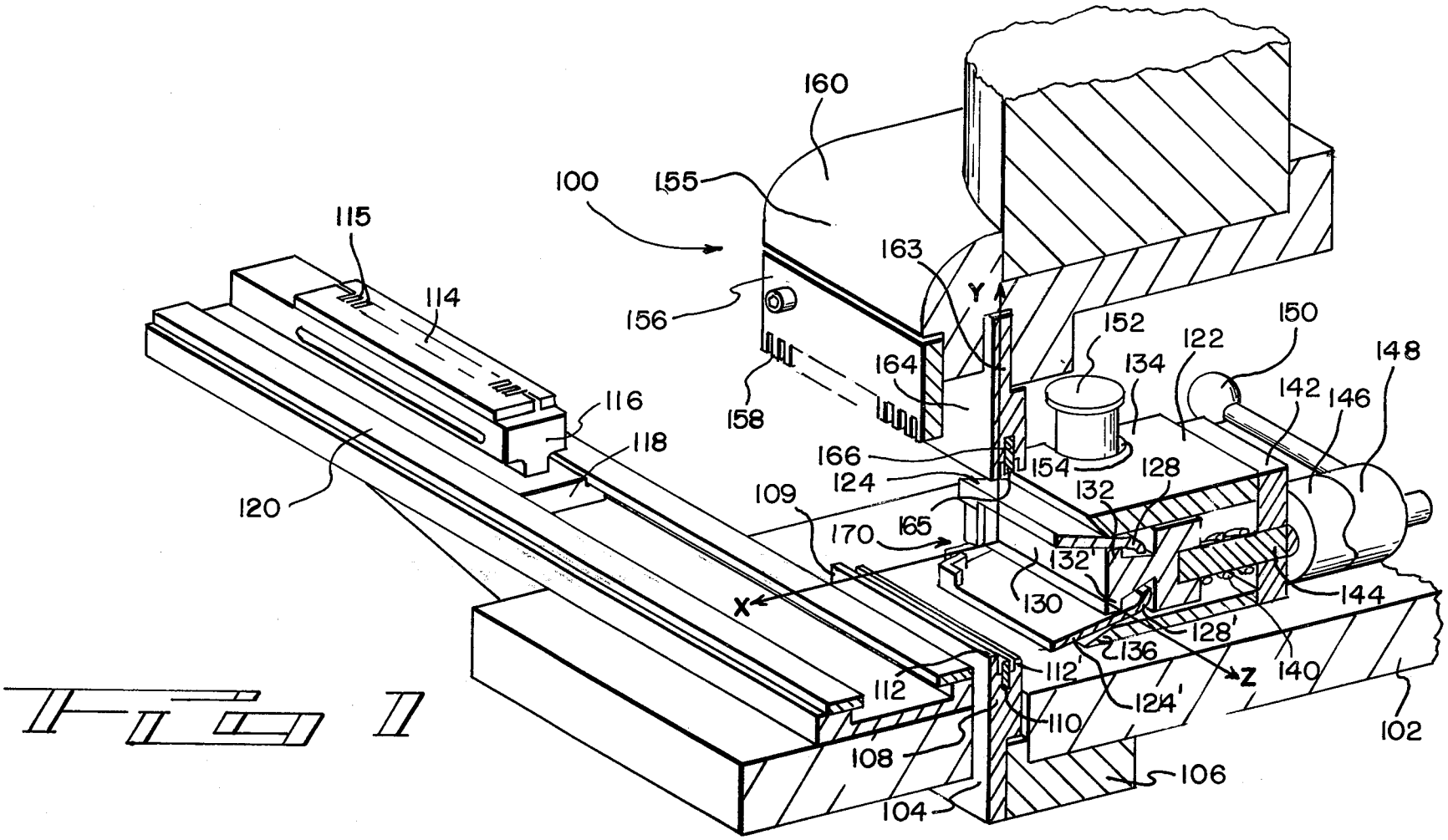
FIG. 1 is a half section of the insertion apparatus.

FIG. 1 is a half section view of a tool which may be used to attach flat cables to a multi-contact connector such as that shown in FIG. 2C. The tool 100 comprises a fixed base 102 with a rectangular central opening 104. Base insertion means 108 is mounted in opening 104 and attached to the mutually adjacent support block 106. Base insertion means 108 thus extends through the opening 104 with the tool head 109 projecting above the upper surface of base 102. Tool head 109 is generally rectangular with three upwardly projecting ribs extending along the length of the tool head. The outer insertion ribs 112 and 112' both extend continuously along the length of the tool head. The center insertion rib 110 consists of a number of teeth equally spaced along the length of the tool head. The details of lower tool head 109 can also be seen in FIG. 9 which clearly shows a number of separate teeth 110.

Figure 8:
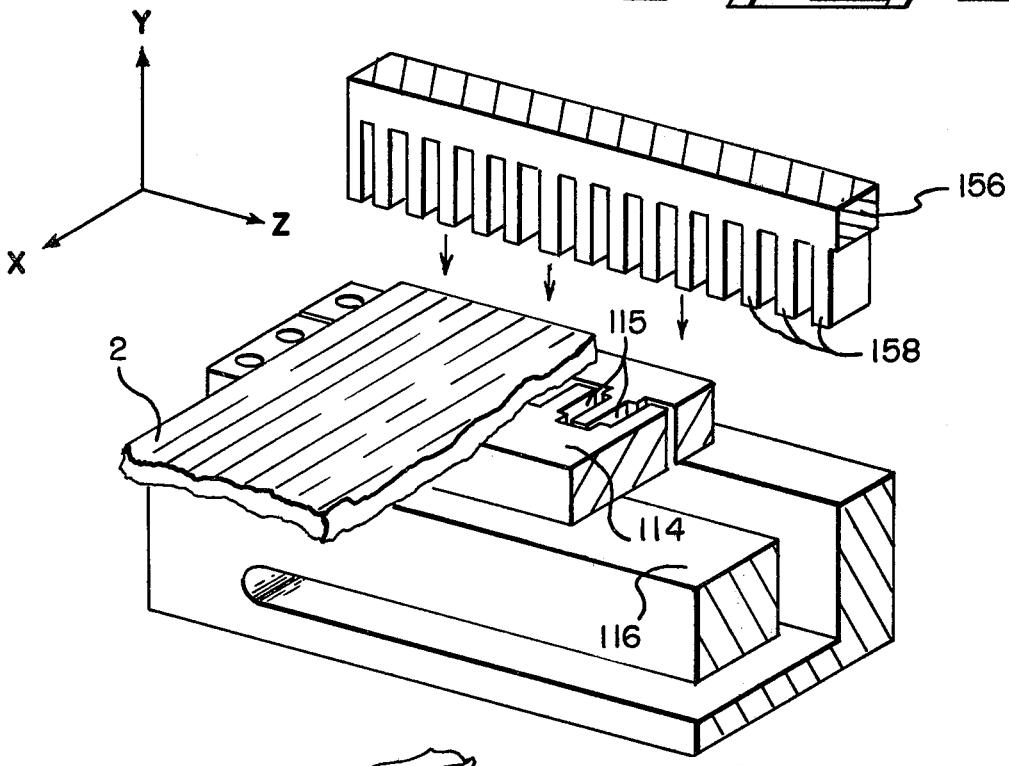
FIG. 8 is a fragmentary perspective view showing the action of the movable punch means and the die means which are used to remove insulation between adjacent conductors.

A laterally extending rail 120 is located on the upper surface of the base 102 immediately adjacent to central opening 104. Rail 120 extends beyond the rearward side of base 102 as shown in FIG. 1. A die 114 is mounted on slide 118 which is in turn mounted on rail 120. This die and slide assembly can then be moved along lateral rail 120 from the position shown in FIG. 1 to a position beside tool head 109. Die 114 has a number of side-by-side holes or slots 115 extending along its length. FIG. 1 does not show all of the details of the die and slide assembly. These details of the die are also shown in FIG. 8 which additionally shows a flat cable properly positioned with respect to the die. Die 114 is mounted on a support block 116. This places the die surface in elevated position with respect to tool head 109.

Connector holding means 122 is located above the upper surface of the base 102 and on the side of central opening 104 across from the die 114. Connector holding means 122 extends along the length of tool head 109. Upper and lower clamshell jaws 124, 124' are located immediately adjacent to the tool head 109 and are of substantially the same length. These jaws are located on one end of support housing 134 and are rotatable due to the camming action described below. A movable piston 130 is located within support housing 134. Each clamshell jaw has a curved surface 128, the inner portions of which rest against upper and lower piston arms 132, 132'. The upper portion of jaw 124, near the points of curvature 128, rests against the top wall 136 of housing 134. A similar situation exists with respect to lower jaw 124'. The jaws 124, 124' are thus slidably in contact with the piston arm and appropriate surfaces on the support housing. Movement of piston 130 to the right in FIG. 1 will cause jaws 124 and 124' to rotate towards each other into a closed position. Piston 130 can be moved to the right by rotating actuating lever 150. Rotation of lever 150 results in a rightward movement of shaft 144 due to the action of stationary camming surface 146 and rotatable camming surface 148. This camming action causes piston head 130 to move against the action of helical spring 140 located between the piston head 130 and rear housing wall 142.

Figure 5:
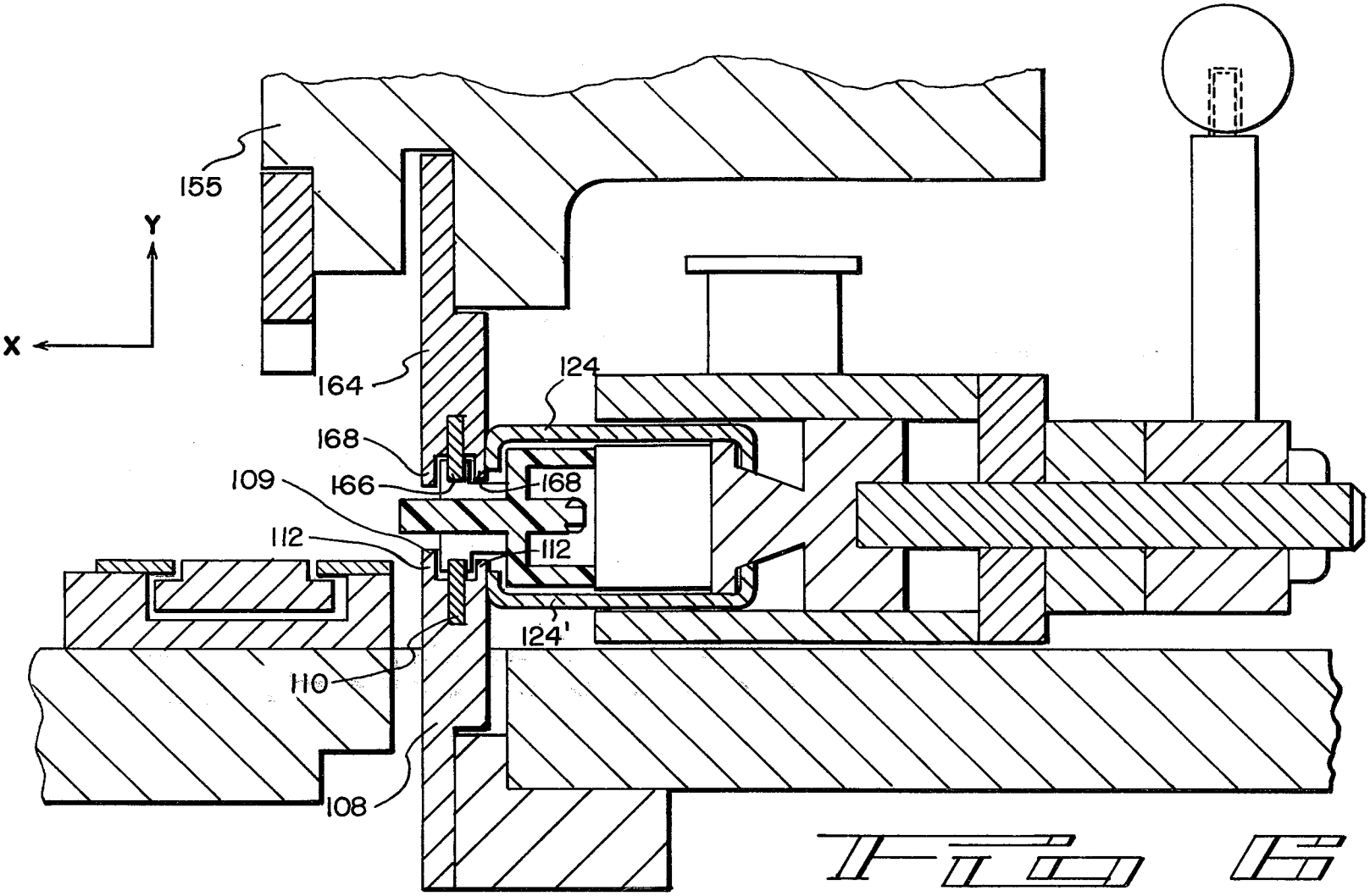
FIG. 5 is a section showing a connector mounted in the connector holding means and the relative position of the movable die means.
Figure 6:
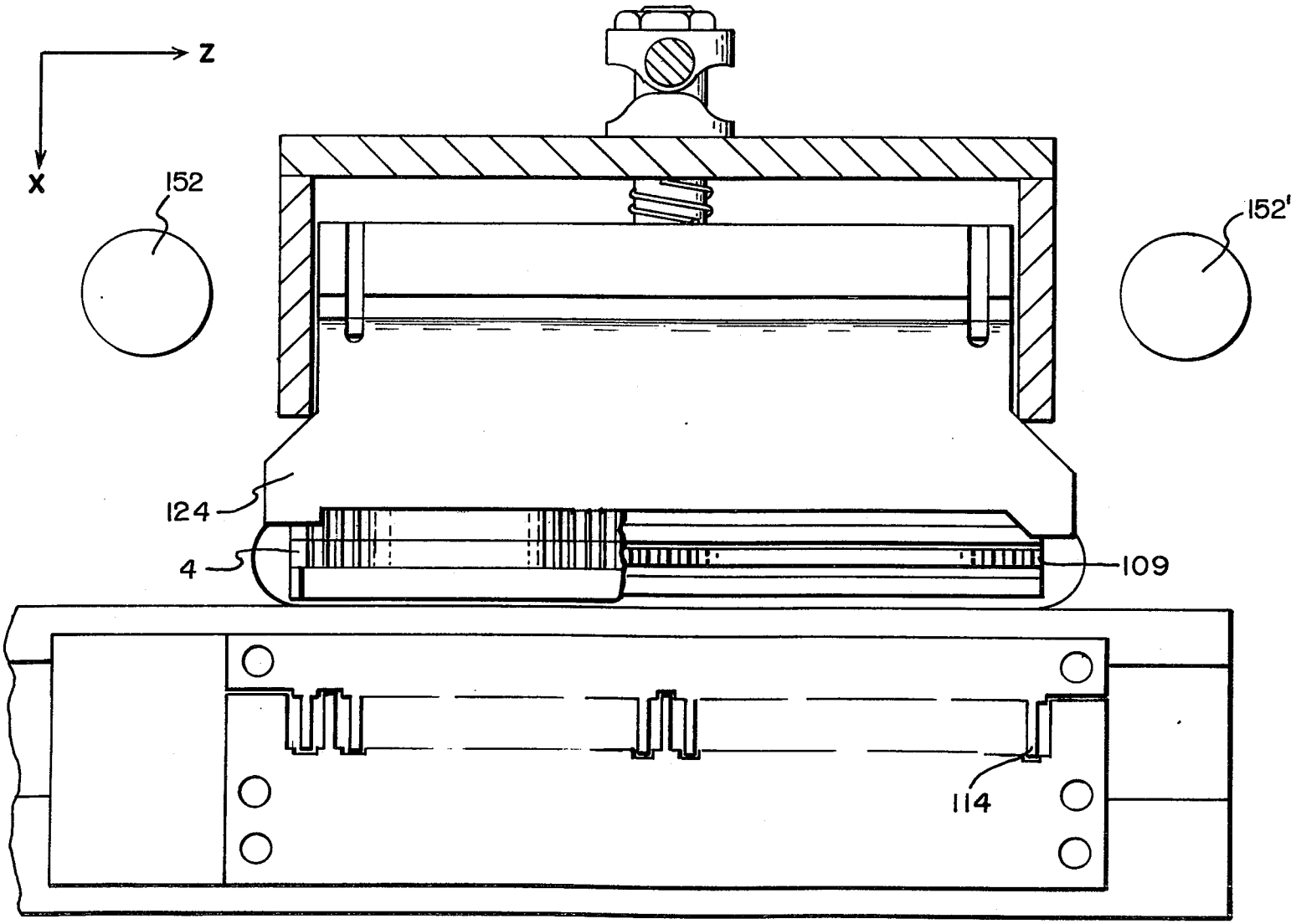
FIG. 6 is a view similar to FIG. 5 but showing the position of the two insertion means and the connector upon full travel of a movable ram.

Connector holding means 122 is mounted on a spring 151 shown in FIGS. 5 and 6. This spring normally holds the connector holder a short distance above fixed base 102. The connector holder 122 can however be moved downward against the action of this spring. A support guide rod 152 is shown at the back side of connector holder 122 in FIG. 1. A substantially identical guide rod 152' would be located on the opposite side as can be seen from FIG. 7. These guide rods are located in guide channels 154. Movement of connector holder 122 is restricted by the channels to rectilinear motion parallel to the axes of these guide rods.

Ram means 155 is located above connector holder 122 as shown in FIG. 1. This ram means can be mounted on any suitable support and is movable towards and away from fixed base 102. Ram punching means 156 and ram insertion means 163 are both fixed to ram frame 160 in side-by-side relationship. Punching means 156 has a number of side-by-side teeth 158 along its lower surface. These teeth 158 are spaced apart so as to be capable of mating with holes 115 in die 114 upon downward travel of ram 155. Ram insertion means 163 has a tool head 165 which is substantially identical to the base tool head 109. Ram insertion means 155 and base insertion means 108 are located in the same plane but remain slightly spaced apart even upon full downward travel of ram 155.

FIG. 1 shows only half of the tool 100 but the complete tool is essentially symmetrical about the section shown. FIG. 7 shows a plan view of the tool when viewed along section 7. As mentioned earlier, the two guide rods 152, 152' are shown. The upper clamshell jaw 124 is also shown. A partial view of a connector 4 contained within jaws 124, 124' is also shown. The right side of this connector has been broken away to reveal the lower tool head 109. It can be seen that the teeth 110 are in alignment with the conductor receiving portions formed by slots 30 and 32 in connector 4. Die 114 has been positioned next to the lower insertion means 108 and the slots or holes 115 can be clearly seen.

Figure 9:
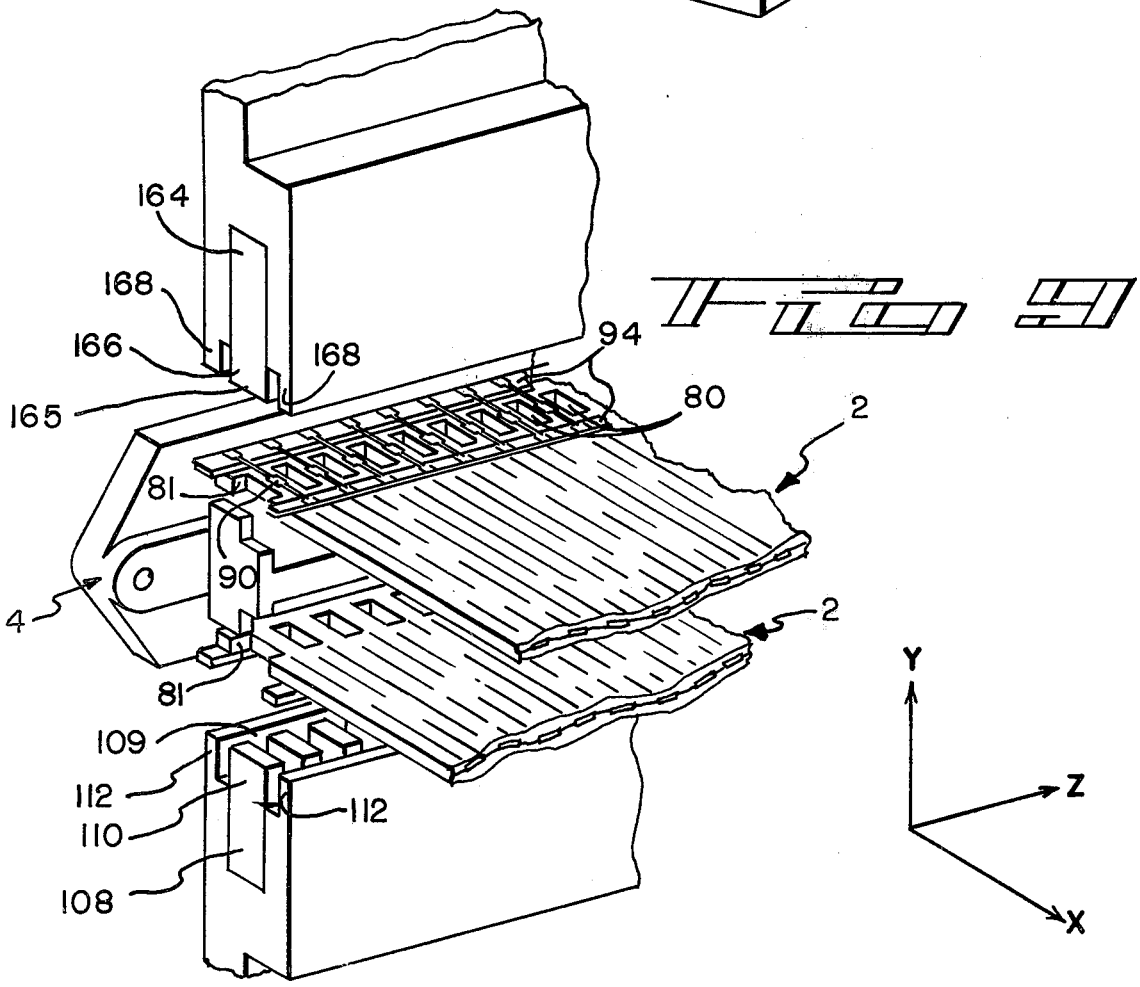
FIG. 9 shows the action of the insertion means with a prepared flat cable and a stuffer pin strip interposed between each insertion means and the adjacent row of contact terminals in the connector.

The movable die 114, the base insertion means 108, the connector holding means 122, and the ram means 155 are positioned so that a working zone 170 is formed at the center of the structure. Access to this central work zone is possible from a number of directions. With this apparatus such access is established along three orthogonal axes. A first orthogonal axis X extends from the work zone 170 past the base insertion means 108 as shown in FIG. 1. A flat cable 2 enters the work zone with the conductors extending in the direction of the first orthogonal axis X. The flat cable can either be placed in the die where holes 80 are punched preparatory to attachment to a connector as shown in FIG. 8 or two cables can be placed on opposite sides of a connector 4 between insertion means 108 and 164 as shown in FIG. 9. In both cases the flat cable extends in the direction of first orthogonal axis X throughout the operation. A second orthogonal axis Y extends from the work zone in the direction of movable ram means 155. Ram means 155 moves along this second orthogonal axis Y to perform both the hole punching and cable insertion operations necessary for the attachment of the flat cables to a connector. The connector holder 122, constrained by guide rods 152 and 152', moves only in the direction of the Y axis against the action of spring 151. The connector holder 122 is pushed downward by the movement of ram means 155 until the connector holder bottoms and cables can be inserted into oppositely facing conductor-receiving portions. The oppositely facing rows of conductor-receiving portions on connector 4 extend in the direction of a third orthogonal axis Z. The longitudinal extension of the punch and insertion means is therefore in the direction of axis Z. Stuffer strip 86, the third element of the final assembly, enters the work zone along the direction of third orthogonal axis Z as shown in FIG. 10.

The insulation between individual conductors 76 in flat cable 2 shown in FIG. 2B can be removed to form rectangular holes 80 by utilizing the ram punch means 156 in conjunction with die 114. FIG. 8 is a schematic clearly demonstrating this operation. Flat cable 2 has been positioned above the die 114. A portion of the cable has been cut away to reveal the die. Upon downward travel of the ram means 155 along the Y axis, the teeth 158 extend through the holes or slots 115 and remove the insulation in an appropriately aligned cable. After this step, movable die 114 may be shifted to the position shown in FIG. 1 where it will not interfere with subsequent operations. The flat cable can now extend past the initial location of the punching means to the insertion station on the other side of work zone 170. It should be noted that holes must be punched in two cables for each insertion operation on a double sided connector such as that with which this apparatus is to be used.

A connector 4 is held in position by grasping jaws 124, 124' which, as discussed previously, may be rotated by a camming action caused by movement of piston 130. Upon movement of the piston 130 to the right in FIG. 1, the jaws begin to close and finally occupy the position shown in FIG. 6. FIG. 6 shows a connector 4 positioned between the jaws with the rearward surface 10 of the connector positioned between upper and lower insertion means 164 and 108 respectively.

Figure 10:
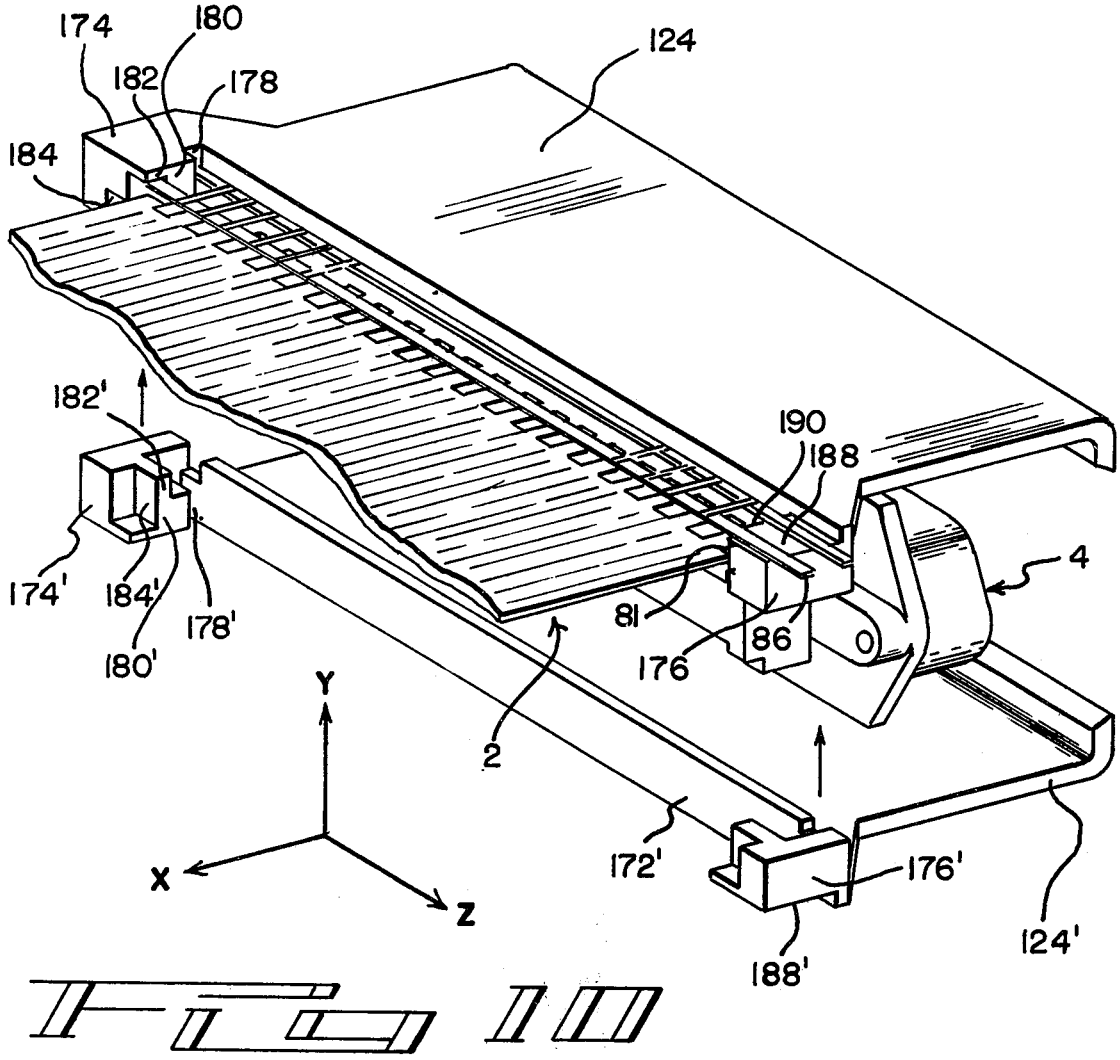
FIG. 10 shows the details of the clamshell jaws used to position the connector.

FIG. 10 shows the details of the clamshell jaws 124 and 124' used for holding a connector 4. Upper jaw 124 is positioned against the connector as it would normally be. Lower jaw 124' is shown displaced from its normal position to reveal the details of the inner surface. Jaws 124 and 124' are essentially mirror images and the features discussed with respect to one apply to the other. Back wall 172 (similar to wall 172' on jaw 124') extending the length of jaw 124 is shown positioned against connector rearward surface 46.

Arms 174 and 176 are located on the ends of the jaw back wall. Together with the back wall, these extensions serve to secure the connector 4 on three sides leaving the rows of conductor receiving portions accessible. Arms 174 and 174' on jaws 124 and 124' respectively consist of generally rectangular blocks extending from corresponding ends of the jaw. A gap 178 partially separates arm 174 from back wall 172 as shown. A rectangular portion 180 of reduced height extends from gap 178 to relatively narrow upright member 182. A cutout 184 then extends from member 182 to the outer end 186 of arm 174. Arm 174' is substantially identical. The flat cable 2 shown in FIG. 10 has been punched so as to leave notches 81 on either end as shown. The gap 178 and member 182 are spaced apart so that notch 81 fits securely therearound. Cable 2 can thus be easily positioned with respect to the conductor receiving portions of connector 4.

Arms 176 and 176' located on the other ends of jaws 124 and 124' respectively are quite similar to arms 174 and 174'. They have equivalent means for engagement of a notch 81 on the other side of the cable 2. The outer surface 188 of arms 176 and 176' is slightly recessed, unlike that on arms 174 and 174'. This recess serves as a platform over which stuffer strip 86 may be fed into proper alignment with cable holes 80 and the conductor receiving portions of connector 4. The inner edge 190 of surface 188 then serves as a cutting edge and a continuous stuffer strip 86 is severed when the appropriate insertion means moves past this cutting edge.

The tool heads on the respective insertion means are constructed so that each individual conductor in the flat cable 2 can be forced into a slot 30 or 32 on the connector. This apparatus performs this function with only one movable ram. Normally, two oppositely moving insertion means must be moved into proximity resulting in the application of insertion forces upon oppositely facing terminals. Here, however, the movable ram means 155 moves downward until upper tool head 165 comes in contact with the connector. At that point, further movement of the ram means causes the entire connector to be moved downward against the action of the spring. Upon full travel of the ram means 155, the connector holder and the connector are brought to a position where each tool head can perform the required operation. In this manner the lower insertion means can remain stationary throughout the operation.

The conductors in two flat cables may be attached to rows of conductor-receiving portions on the opposite faces of a multi-contact connector by using the described apparatus to perform the following operations. First the cooperating die and movable punch means are used to punch holes between conductors at a point adjacent to one end of a flat cable. This requires two strokes of the ram, one for each cable. The die can then be moved away from the working zone. A multi-contact connector is then placed with the conductor-receiving portions positioned in the working zone. The ends of both flat cables are then extended past the locations of the punching operation and placed in alignment with the oppositely facing conductor-receiving portions. A strip containing side-by-side stuffer pins is then fed into the working zone and into alignment with the individual conductor and the individual conductor-receiving portions. It should be noted that each multi-conductor cable has been positioned between a row of conductor-receiving portions and a strip of stuffer pins. At this point a third stroke of the ram performs the final insertion. As the ram moves toward the fixed base during this third stroke, the movable insertion means exerts a force upon the connector. This force is exerted along the adjacent row of conductor-receiving portions. This force acts to move the connector and connector holder toward the fixed base and against the operation of the intermediate spring. Eventually the other row of conductor-receiving portions comes into contact with the lower fixed insertion means. The oppositely facing rows of conductor-receiving portions are then constrained by the two insertion means and the cable and the stuffer pins can then be simultaneously forced into the appropriate conductor-receiving portions.

What is claimed is:

1. Apparatus for inserting individual conductors in a multi-conductor flat cable into the conductor-receiving portions of electrical contact terminals which are contained in a multi-contact electrical connector, said conductor-receiving portions being arranged in rows on oppositely facing surfaces of said connector, said apparatus comprising:

a work zone located at the intersection of first, second, and third orthogonal axes, said work zone being oriented so that said conductors may extend into said work zone in the direction of said first orthogonal axis, a fixed base, said base having die means and base insertion means which may be utilized alternatively for punching holes in said cable and inserting the perforated cables into said conductor-receiving portions, ram means movable along said second orthogonal axis towards and away from said fixed base, said ram means having ram punch means and ram insertion means, said ram insertion means being in permanent alignment with said base insertion means, connector holding means for holding said connector with said rows extending along said third orthogonal axis and with said rows in alignment with said ram insertion means and said base insertion means whereby holes may be punched between said individual conductors in said flat cable by the combined action of said ram punch means and said die means and then said multiconductor flat cables may be aligned with said conductor-receiving portions and attached to said connector by the combined action of said ram insertion means and said fixed base insertion means, each of said operations being performed in a working zone located at the intersection of said first, second and third orthogonal axes.

2. An apparatus as set forth in claim 1 wherein said connector holding means is located between said ram means and said fixed base, said connector holding means being held in spaced-apart relationship from said fixed base by the action of spring means located therebetween.

3. An apparatus as set forth in claim 2 wherein said connector holding means consists of clamshell jaws.

4. An apparatus as set forth in claim 3 wherein said jaws having cable locating means for use in aligning said conductors with said conductor-receiving portions, said cable locating means comprising means for engaging notches on opposite sides of said cable.

5. An apparatus as set forth in claim 4 wherein said connector holding means having locating means for positioning a strip of stuffer pins with each individual pin in alignment with one of said conductors and the corresponding aligned conductor-receiving portion.

6. An apparatus as set forth in claim 5 wherein said each of said clamshell jaws has a cutting edge for severing a continuous strip of stuffer pins upon passage of an edge on said insertion means past said cutting edge.

7. An apparatus as set forth in claim 6 wherein said die means are movable.

8. A method for attaching the individual conductors in two multi-conductor flat cables to the conductor-receiving portions of a multi-contact connector, said conductor-receiving portions consisting of slots in contact terminals which are aligned in first and second oppositely facing rows, said method comprising the steps of:

punching holes between the conductors in two flat cables at a location adjacent to one end of said cables so that a portion of the insulation is removed, positioning said connector in a movable connector holding means, aligning said conductors in each of said flat cables with said slots in said first and second oppositely facing rows, aligning stuffer pins with said conductors and with said corresponding slots, said stuffer pins being held by a continuous carrier strip, locating cutting edges on each side of said connector between said cables and said strips, said cutting edges being parallel to said conductors and positioned to one side of each of said cables with said continuous strip extending across said cutting edges, moving a ram containing movable insertion means towards fixed insertion means, said cables, said stuffer pins and said connector being located therebetween, so that said movable insertion means exerts a force on said first row adjacent to said movable insertion means which moves said connector so that said second row abuts said fixed insertion means, exerting an additional force on said movable insertion means so that each insertion means moves past the adjacent cutting edge severing said continuous strips and then forcing said conductors and stuffer pins into the aligned slots, whereby electrical contact is established between said slots and said conductors and said stuffer pins insure continued contact therebetween.

* * * * *